United States Patent [19]

Marcet et al.

[11] 4,093,292

[45] June 6, 1978

[54] SLING AND ITS METHOD OF MANUFACTURE

[76] Inventors: Jose Maria Maso Marcet, calle Navas de Tolosa 353; Jose de Calasanz Peradejordi Guanabens, calle Enrique Granados 101, both of Barcelona, Spain

[21] Appl. No.: 775,106

[22] Filed: Mar. 7, 1977

Related U.S. Application Data

[63] Continuation-in-part of Ser. No. 560,990, Mar. 21, 1975, abandoned.

[30] Foreign Application Priority Data

| | | |
|---|---|---|
| Apr. 1, 1974 | Spain | 201899 |
| Nov. 13, 1976 | Spain | 224442 |

[51] Int. Cl.[2] ..... B66C 1/18

[52] U.S. Cl. ..... 294/74

[58] Field of Search ..... 294/74–77; 57/141, 142, 144, 145, 158, 160, 166; 87/7, 8; 124/90; 224/49; 267/63 R, 69, 73

[56] References Cited

U.S. PATENT DOCUMENTS

| | | | |
|---|---|---|---|
| Re. 26,704 | 11/1969 | Norton | 294/74 |
| 1,465,801 | 8/1923 | Bell | 124/90 |
| 1,962,585 | 6/1934 | Faure-Roux | 267/63 R |
| 2,426,538 | 8/1947 | Von Wehrden | 294/74 X |
| 2,769,439 | 11/1956 | Layer | 124/90 |
| 3,310,333 | 3/1967 | Hutson | 294/74 X |
| 3,411,400 | 11/1968 | Morieras et al. | 87/8 |
| 3,718,945 | 3/1973 | de Treglode | 294/74 X |

FOREIGN PATENT DOCUMENTS

| | | | |
|---|---|---|---|
| 1,050,789 | 12/1966 | United Kingdom | 294/74 |

*Primary Examiner*—Johnny D. Cherry
*Attorney, Agent, or Firm*—Michael J. Striker

[57] ABSTRACT

A sling for moving loads is comprised of a coil having a multitude of substantially uniform, closed and juxtaposed loops. The loops are elongated to form a middle portion of two substantially parallel adjacent coil sections, and a pair of bight-shaped portions at opposite ends of the middle portion. Each coil section is comprised of a plurality of filamentary material strands which are spaced from each other. A plurality of windings are wound about strands in each of the coil sections so as to retain these coil sections in substantial parallelism adjacent each other during movement of a load. Each winding has a plurality of substantially annular turns which comprise a run located in the interspaces bounded by the strands. The run extends from one to the other of the coil sections in direction transversely of the elongation of the loops and serves to interconnect these coil sections and to prevent them from moving apart from each other when one of the bight-shaped portions is urged in direction away from the other of the bight-shaped portions during movement of the load. A method of making the sling is also disclosed.

7 Claims, 10 Drawing Figures

FIG.1
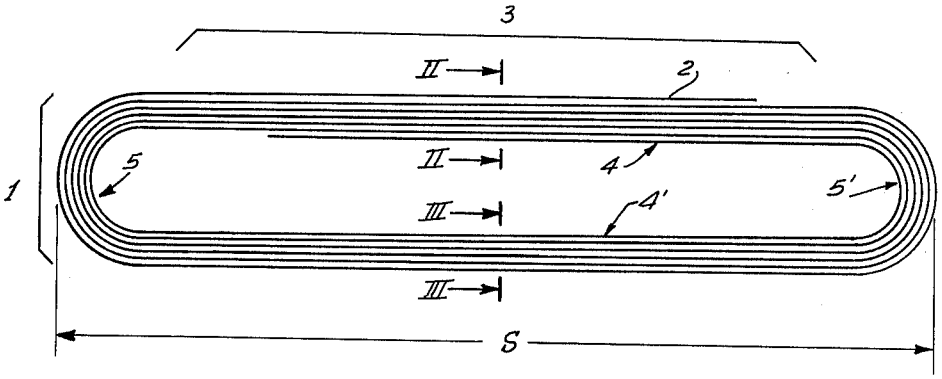
FIG. 4
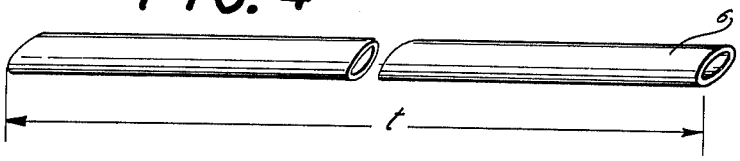
FIG. 5
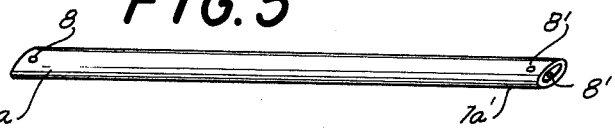
FIG. 6
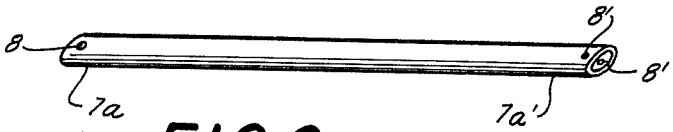
FIG. 2
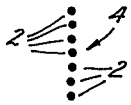
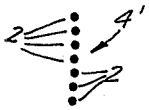
FIG. 3
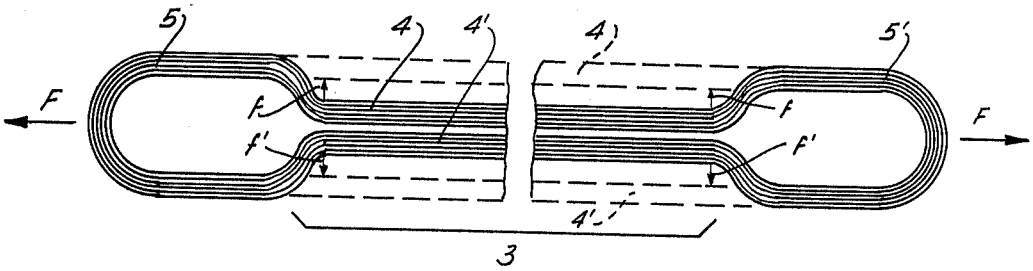
FIG. 7

FIG. 8
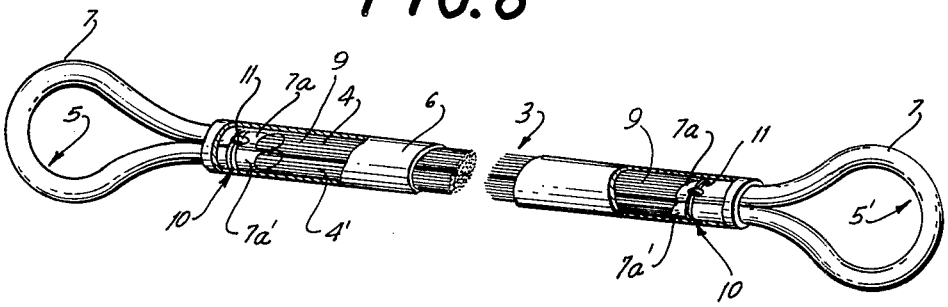
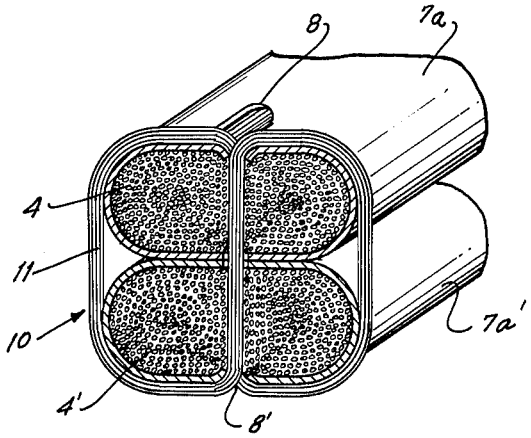
FIG. 9
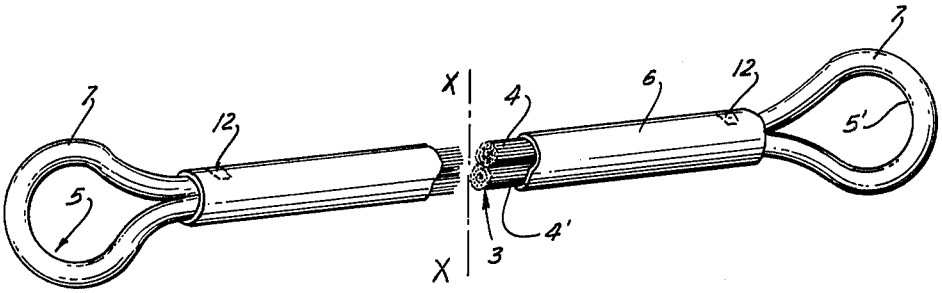
FIG. 10

SLING AND ITS METHOD OF MANUFACTURE

CROSS-REFERENCE TO RELATED APPLICATIONS

The present application is a continuation-in-part application of Ser. No. 560,990, filed Mar. 21, 1975, for "A Sling" now abandoned.

BACKGROUND OF THE INVENTION

The present invention relates to a sling and to its method of manufacture and, more particularly, to heavy-duty slings which are required to move loads of substantial weight.

Many industrial and commercial operations require the handling and transporting of loads. In many commercially-significant cases, such loads are of great weight. In order to move such loads from place to place, one generally selects a load-lifting device which corresponds in strength and size to the load to be moved.

It has been proposed to use slings in many different applications for moving loads such as heavy machinery. Generally speaking, slings are lengths of rope, cable, band, chain, belt or the like having bight-shaped end portions, also called loops or eyes. Such slings are versatile load-lifting devices and are easily adaptable to the particular size, contour and weight of the load to be moved.

It has been proposed to make a sling of a length of rope with bight portions formed by bending the ends of the rope into a loop shape and, thereupon, by attaching these ends to the main rope portion by sewing, braiding or tieing.

It has also been proposed to make a sling of a flat band with bight portions formed by bending the ends of the band into a loop shape and, thereupon, by attaching such ends to the main band by sewing or by stapling.

It has further been proposed to form slings of many turns of a flat band or of a belt and, thereupon, to interconnect the various juxtaposed turns by sewing therethrough with thread. However, such slings do not have a high load-lifting capability, because the thread stitches pass through the various juxtaposed turns. By piercing through the juxtaposed turns, the overall strength of the sling is actually weakened.

It has still further been proposed to form slings of flexible steel cable or similar metal material. In such cases, the bight-shaped end portions are formed by bending the ends of the cable and, thereupon, by attaching the cable ends to the main cable by means of clampable retaining rings. Although such slings are effective for their intended purpose, they have the serious disadvantage of mechanically damaging the load during lifting. It has been found that the steel cable and the metallic clamps actually mar and scratch the load to be moved, thereby substantially damaging the latter.

Another prior-art proposal utilizes metal links successively connected one after another in a manner similar to chains. These links may be small, or simple in construction, or large, or complex in construction. In any case, such slings have the decided disadvantage that they are only as strong as their weakest link.

Still another prior-art proposal utilizes a metal core covered at its exterior with an elastomeric substance. Such slings are not flexible so as to easily conform to the contour of a load to be moved. Furthermore, such slings are prone to frequent damage inasmuch as the elastomeric substance can be cut relatively easily by sharp metallic edges found on many loads to be moved.

SUMMARY OF THE INVENTION

Accordingly, it is the general object of the present invention to overcome the disadvantages of the prior art.

Another object of the present invention is to provide a heavy-duty sling for moving loads of large weight.

Still another object of the present invention is to provide a sling which will not mar or otherwise damage the load to be moved.

Yet another object of the present invention is to provide a sling which easily conforms to the contour of a load to be moved.

Still a further object of the present invention is to provide a method of manufacturing a sling having a high load-lifting capability.

In keeping with these objects and others which will become apparent hereinafter, one feature of the invention resides, briefly stated, in a sling for moving loads, which comprises a coil having a multitude of substantially uniform, closed and juxtaposed loops. The loops are elongaated to form a middle portion of two substantially parallel adjacent coil sections, and bight-shaped portions at opposite ends of the middle portion so that one of the bight-shaped portions may be connected with a load to be moved. Each coil section is comprised of filamentary material strands which are spaced from each other. Both coil sections are retained in substantial parallelism adjacent each other during lifting of a load by winding means. The winding means comprises at least one winding having a plurality of substantially annular turns extending circumferentially about strands in each of the coil sections. The turns include a run located in interspaces bounded by the strands and extends from one to the other of the coil sections in direction transversely of the elongation of the loops for interconnecting the coil sections and for thereby preventing them from moving apart from each other when the first-mentioned bight-shaped portion is urged in direction away from the other of the bight-shaped portions during movement of the load.

Advantageously, the coil is comprised of a high number of loops formed by at least one single continuous flexible strand of filamentary material. Additional strands may also be employed. Moreover, each strand may be of a unifilar element or of multifilar elements. Some characteristic properties of such elements are that they are relatively thin, very flexible, relatively tough, fibrous and relatively soft.

In accordance with the invention, the winding means interconnects the coil sections and prevents them from moving apart from each other during movement of a load. The greater the number of annular turns of the winding means which surround the strands in both coil sections, the greater will be the retaining force which holds the coil sections in substantial parallelism adjacent each other.

Also, in accordance with the invention, the bight-shaped portions are surrounded by protective sleeves, and the middle portion is surrounded by a substantially tubular protective sheath. The sleeves are stitched to opposite ends of the sheath so as to prevent relative shifting of the sleeves with respect to the sheath during lifting of a load. During such lifting, the coil sections are urged away from each other. This movement is prevented substantially by the winding means and, to a lesser extent, by the sheath. Advantageously, the threaded fastening intermediate the sleeves and sheath is not damaged due to the tendency of the coil sections to move apart from each other, because of the outward location of the stitching relative to the winding means. In other words, the force which tends to separate the coil sections is initially and substantially dissipated by the winding means. Thus, the threaded seam is protected from damage and relative movement between the sleeves and the sheath is prevented, even for loads of substantial weight.

In further accordance with the invention, the protective sleeves and the sheath are formed of flexible textile material. The flexibility of the material permits the sling to conform to the contour of a load to be moved, and the relatively soft textile material will not mar or otherwise damage a load to be moved. This is a very great advantage because most slings currently used cause scores, small breaks, scratches and other damage when they are applied directly against the load to be carried or supported.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a purely diagrammatic view depicting a coil in accordance with the present invention;

FIG. 2 is a cross-sectional view taken along line II—II of FIG. 1;

FIG. 3 is a cross-sectional view taken along line III—III of FIG. 1;

FIG. 4 is a perspective view of a tubular sheath in accordance with the present invention;

FIG. 5 is a perspective view depicting a protective sleeve in accordance with the present invention;

FIG. 6 is a perspective view showing another protective sleeve in accordance with the present invention;

FIG. 7 is a purely diagrammatical view which graphically depicts the various forces acting upon the coil of FIG. 1 during lifting;

FIG. 8 is a perspective view of a sling in accordance with the present invention, with some portions thereof removed to show the interior construction of the sling;

FIG. 9 is an enlarged view in partial cross-section of a detail of FIG. 8; and FIG. 10 is a perspective view of the sling in assembled configuration in accordance with the present invention.

DESCRIPTION OF THE PREFERRED EMBODIMENTS

Referring firstly to FIG. 1 of the drawings, the coil 1 is comprised of a multitude of substantially uniform, closed and juxtaposed loops or turns. It is to be understood that only several loops have been illustrated for the sake of clarity. As the number of loops is increased, the relative load-bearing characteristic of the sling will be increased accordingly. In practice, the number of loops may range from a few loops to over a thousand loops or more depending upon the particular application, i.e., the weight of the load to be moved, the nature and strength of the strand material comprising the coil, the safety factor required, etc.

The coil 1 advantageously comprises at least a single continuous flexible strand of filamentary material 2. Additional strands could also be used to obtain the desired number of loops. The strand material 2 itself may be of unifilar construction, or multifilar construction.

The coil 1 is elongated to form a middle portion 3 and bight-shaped portions 5, 5' at opposite ends of the middle portion 3. The middle portion 3 is comprised of two substantially parallel coil sections 4, 4' which lie adjacent to each other. The coil 1 has a length designated by the letter *s*.

Referring now jointly to FIGS. 2 and 3 which show various cross-sections of the coil sections 4 and 4', it is noted that each coil section has a plurality of strands each of which are slightly spaced from each other. It is noted that, in practice, the various strands in each coil section will not lie precisely one above the other in a linear row as indicated in FIGS. 2 and 3, but will instead be slightly displaced, either to the right or the the left, with respect to the other strands. Thus, these Figures are intended to show the interspaces which exist between the various strand portions, and the fact that each of these strand portions extend generally along the same direction in mutual substantial parallelism with each other.

FIG. 4 shows a substantially tubular, flexible sheath 6, preferably of soft textile material, for covering the middle portion 3. Sheath 6 has a length *t* smaller than length *s* of the coil. The sheath 6 surrounds both coil sections 4, 4'.

FIGS. 5 and 6 respectively show two substantially tubular, flexible protective sleeves 7, preferably of soft textile material, for covering the bight-shaped portions 5, 5'. Each sleeve 7 has spaced end regions *7a, 7a'*. Each end region *7a* is formed with a pair of juxtaposed holes 8; each end region *7a'* is formed with a pair of juxtaposed holes 8'.

FIG. 7 depicts the various forces acting upon the coil 1 during movement of a load. One of the bight-shaped portions is coupled to a load to be moved, whereas the other of the bight-shaped portions is coupled to a drive or support. Thus, the vector forces acting on bight-shaped portions 5, 5' act in opposite directions and have been identified by arrows F, i.e., the bight-shaped portions 5, 5' are urged in direction away from each other.

By virtue of the forces F, the coil sections 4, 4' tend to move apart from each other from the solid line position towards the dashed-line position of FIG. 7. The vector forces acting on the ends 9 of the middle portion 3 act in opposite direction to each other in direction generally normal to the direction of the arrows F and have been identified by arrows *f,f'*.

In order to counteract forces *f,f'* and thereby to retain the coil sections 4, 4' in substantial parallelism adjacent each other during lifting or moving of a load, winding means 10, as shown in FIG. 8, are provided at ends 9 of the middle portion 3. The winding means 10 comprises at least one winding, and preferably a pair of windings at each end 9, which has a plurality of substantially annular turns 11 extending circumferentially about strands in each of the coil sections 4, 4'. Each turn 11 passes through the juxtaposed holes 8, 8' which are respectively located at ends *7a, 7a'* of each sleeve 7. A plurality of such turns 11 constitutes a run which, as shown in the enlarged view of FIG. 9, is located in the interspaces bounded by the strands in coil sections 4, 4'. The run extends from one to the other of the coil sections in direction transversely of the elongation of the loops of the coil. Thus, the coil sections are interconnected and are prevented from moving apart from each other when the bight-shaped portions are subjected to the forces F.

The number of turns 11 depicted in FIG. 9 is exemplary only. The actual number chosen depends upon the particular application and the strength desired in order to counteract the expected forces *f,f'*. The various turns 11 are tightly wound about end regions *7a, 7a'* so that the latter are brought into tight engagement with each other.

FIG. 10 shows the sling in assembled condition. Fastening means 12 for preventing relative movement between the protective sleeves 7 and the sheath 6 are provided at opposite ends of the middle portion 3. Preferably, the fastening means 12 comprises a seam of threaded stitches 12 which interconnect the sleeves 7 and the sheath 6. The threaded seam 12 is located exteriorly of the winding means 10. In accordance with the invention the forces *f, f'* are substantially counteracted by the winding means 10. Thus, the forces *f,f'* are greatly, if not entirely, dissipated in magnitude before they can exert any pressure against the stitches 12. In this way the stitches 12 are protected from being loosened or otherwise damaged. This means that undesired relative movement between the sleeves 7 and the sheath 6 is likewise prevented.

It is a salient feature of the invention that the stitches 12 and winding means 10 cooperate so as not to decrease the overall load-bearing capacity of the sling. In the prior art, the stitches 12 penetrate through the material of the juxtaposed coil loops and therefore actually serve to decrease the sling strength. In the present invention, the various turns of the winding means do not pass through the material of the loop itself, but instead pass through interspaces bounded by the coil loops.

Thus, the stitches 12 serve mainly to prevent shifting of the sleeves 7 relative to the sheath 6, and not primarily to support the load. Tests have indicated that, when loads on the order of 5000 or 6000 kilograms are to be moved, conventional slings, i.e., slings not having winding means as described above, are not reliable, because the stitches 12 are destroyed due to the action of forces *f,f'*.

The sleeves 7 and the sheath 7 are advantageously of flexible material so as to cooperate with the flexible filamentary material strands to thereby permit the sling to easily conform to the outer contour of a load to be moved. Moreover, the sleeves 7 and the sheath 6 are advantageously of textile material which is relatively softer than the load to be moved so that such load may be moved without causing damage thereto. Machines, pleasure boats, land vehicles, and a wide variety of items can be supported and transported most securely and without any danger of damage occurring thereto by virtue of any metal-to-metal contact, as is conventional with the prior-art slings.

The sling is symmetrical with respect to the axis of symmetry X-X, as shown in FIG. 10. The threaded seam 12 extends generally in direction transversely of the elongation of the coil, and also generally transversely of this axis of symmetry.

It will be understood that each of the elements described above, or two or more together, may also find a useful application in other types of constructions differing from the types described above.

While the invention has been illustrated and described as embodied in a sling and its method of manufacture, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sling for moving loads, comprising a coil having a multitude of substantially uniform, closed and juxtaposed loops, said loops being elongated to form a middle portion of two substantially parallel adjacent coil sections, each coil section having filamentary material strands which are located adjacent to each other, and bight-shaped portions at opposite ends of said middle portion so that one of said bight-shaped portions may be connected with a load to be moved; means for retaining said coil sections in substantial parallelism adjacent each other when a load is to be moved, said retaining means including winding means having a plurality of substantially annular turns extending circumferentially about strands in each of said coil sections, said turns including a run located in interspaces bounded by said strands and extending from one to the other of said coil sections in direction transversely of the elongation of said loops for interconnecting said coil sections and for preventing them from moving apart from each other when said one bight-shaped portion is urged in direction away from the other of said bight-shaped portions during movement of the load, said retaining means including a substantially tubular flexible sheath surrounding said coil sections and having a length which extends over a substantial portion of the length of the coil; means for protecting said bight-shaped portions and including a pair of flexible protective sleeves each surrounding a respective one of said bight-shaped portions; and means for preventing relative movement between said protective sleeves and said sheath, and including means for fastening said sleeves to opposite ends of said sheath, said fastening means including a threaded seam of stitches interconnecting said sleeves and said sheath, said threaded seam of stitches being located exteriorly of said winding means so that relative movement of said coil sections apart from each other during movement of the load is counter-acted substantially by said winding means, whereby said threaded seam of stitches is protected from damage to thereby prevent relative movement between said sleeves and said sheeth.

2. A sling as defined in claim 1, wherein said coil is annular and is comprised of a single, continuous, flexible, filamentary material strand.

3. A sling as defined in claim 1, wherein said winding means comprises two pairs of windings, each pair being located at opposite ends of said middle portion, and each winding having a run interconnecting said coil sections.

4. A sling as defined in claim 3, each of said sleeves having end regions at opposte ends of said middle portion, said end regions of each sleeve at each end of said middle portion being formed with juxtaposed holes for receiving two of said runs of each pair of windings.

5. A sling as defined in claim 4, wherein each winding has a plurality of turns each of which surrounds said end regions of a respective sleeve in direction transversely of the elongation of said loop of said coil.

6. A sling as defined in claim 1; said sleeves and said sheath being of textile material which is relatively softer than the load to be moved so that the load may be moved without causing damage thereto.

7. A sling for moving loads, comprising an annular coil having a multitude of substantially uniform, closed and juxtaposed loops formed by a single, continuous, flexible strand of soft fibrous filamentary material, said loops being elongated to form a middle portion of two substantially parallel adjacent coil sections, each coil section having a plurality of strand elements which are located adjacent each other, and bight-shaped portions at opposite ends of said middle portion so that one of said bight-shaped portions may be connected with a load to be moved; means for retaining said coil sections in substantial parallelism adjacent each other when a load is to be moved, said retaining means including winding means having two pairs of windings, each pair being located at opposite ends of said middle portion, and each winding having a plurality of substantially annular turns extending circumferentially about said strand elements in each of said coil sections, said turns of each of said windings including a run located in interspaces bounded by said strand elements and extending from one to the other of said coil sections in direction transversely of the elongation of said loops for interconnecting said coil sections and for preventing them from moving apart from each other when said one bight-shaped portion is urged in direction away from the other of said bight-shaped portions during movement of the load; meanns for protecting said bight-shaped portions, said protecting means including a pair of flexible protective sleeves of textile material, each sleeve surrounding a respective one of said bight-shaped portions and having end regions formed with juxtaposed holes for receiving two of said runs of each pair of windings, a substantially tubular flexible sheath of textile material surrounding said sections so that all portions of said coil are covered with a flexible soft covering for permitting the sling to conform to the contour of a load to be moved without causing damage to the load itself; and fastening means at opposite ends of said sheath for preventing relative movement between said protective sleeves and said sheath, said fastening means including a threaded seam of stitches interconnecting said sleeves and said sheath, said threaded seam of stitches being located exteriorly of said winding means so that relative movement of said coil sections apart from each other during movement of the load is counteracted substantially by said winding means, whereby said threaded seam of stitches is protected from damage to thereby prevent relative movement between said sleeves and said sheath during movement of the load.

* * * * *